US005775656A

United States Patent [19]

Roberts et al.

[11] Patent Number: 5,775,656

[45] Date of Patent: Jul. 7, 1998

[54] SHELF HOLDER

[75] Inventors: Clifford John Roberts, London; Keith Brazier, Southend-on-Sea; Bryan Christopher Harrison, Hampshire; Timothy John Hedley Nicholson, Berkshire, all of United Kingdom

[73] Assignee: Cliffhanger (Export) Limited, United Kingdom

[21] Appl. No.: 605,594

[22] Filed: Feb. 22, 1996

[30] Foreign Application Priority Data

Feb. 24, 1995 [GB] United Kingdom ..... 9503803

[51] Int. Cl.[6] ..... A47G 29/02

[52] U.S. Cl. ..... 248/250; 248/248; 211/90; 108/152

[58] Field of Search ..... 248/250, 247, 248/235, 558, 316.4; 108/108, 27, 192, 180, 106, 110

[56] References Cited

U.S. PATENT DOCUMENTS

| | | | |
|---|---|---|---|
| 618,669 | 11/1899 | Marlowe . | |
| 750,595 | 1/1904 | Campbell . | |
| 883,323 | 3/1908 | Macduff . | |
| 999,226 | 8/1911 | Houghton . | |
| 1,067,850 | 7/1913 | Warner . | |
| 2,906,487 | 9/1959 | Simon | 248/250 |
| 3,471,112 | 10/1969 | MacDonald et al. | 248/250 |
| 3,606,229 | 9/1971 | Wall | 248/235 |
| 4,709,892 | 12/1987 | Gurgui | 248/250 |
| 4,720,069 | 1/1988 | Bessinger | 248/250 |
| 4,736,919 | 4/1988 | Bessinger | 248/250 |
| 5,104,080 | 4/1992 | Berger | 248/250 |
| 5,360,192 | 11/1994 | Hella | 248/250 |
| 5,456,435 | 10/1995 | Sweeney | 248/250 |

FOREIGN PATENT DOCUMENTS

| | | |
|---|---|---|
| 0330599 | 2/1989 | European Pat. Off. . |
| 0543063 | 11/1991 | European Pat. Off. . |
| 2584586 | 7/1985 | France . |
| 2624708 | 12/1987 | France . |
| 0330599 | 8/1989 | France . |
| 2664141 | 1/1992 | France . |
| 2701520 | 8/1994 | France . |
| 3106103 | 12/1982 | Germany . |
| 3704889A | 8/1988 | Germany . |
| 618669 | 1/1947 | United Kingdom . |
| 2047077 | 11/1980 | United Kingdom . |
| 2232343 | 12/1990 | United Kingdom . |
| 9111939 | 4/1991 | WIPO . |

*Primary Examiner*—Ramon O. Ramirez
*Assistant Examiner*—Kimberly Wood
*Attorney, Agent, or Firm*—Cesari and McKenna, LLP

[57] ABSTRACT

A shelf holder has a first component which supports the underside of the shelf and a second component which grips the top of the shelf, being tightened by screws. The component slides vertically relative to the component, and has feet which project through vertical openings in a wall-engaging part of the first component, the feet having slots which engage the sides of the openings and provide stability. In order to conceal the mechanism, there is a top cover piece which clips over the top lip and a bottom cover piece in two parts, the first of which lies on top of the support part of the first component and the second of which conceals the bottom portion of the shelf holder.

25 Claims, 5 Drawing Sheets

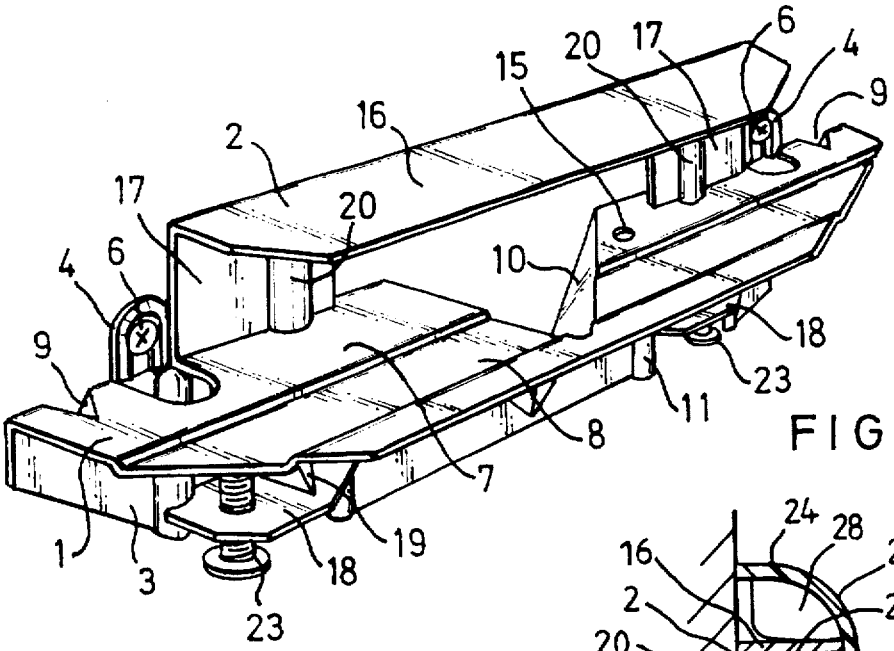
FIG.1
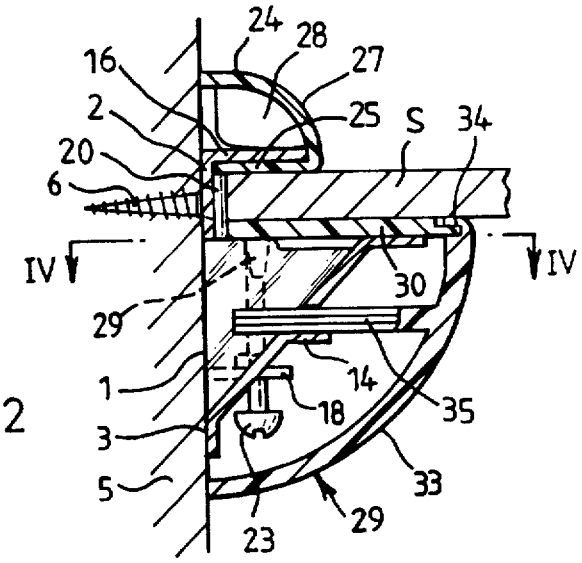
FIG.2
FIG.3
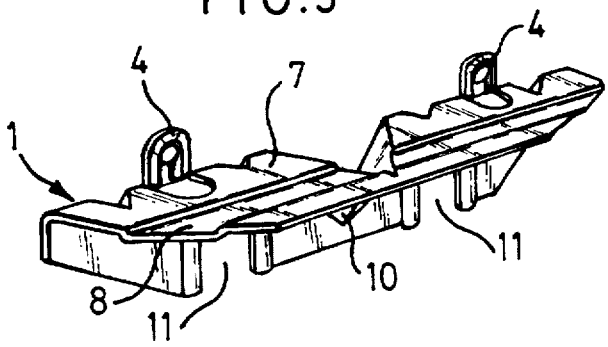

SHELF HOLDER

BACKGROUND OF THE INVENTION

The first aspect of the invention relates to a shelf holder, for fixing to a generally vertical surface, for supporting the underside of a shelf and gripping the rear portion of the shelf, the holder comprising a first component having a first part for engaging the generally vertical surface, a support part for supporting the bottom of the shelf, and means for fixing the first component to the generally vertical surface, a second component moveable vertically with respect to the first component and having a gripping part for bearing on the top of the rear portion of the shelf, and tightening means for moving the gripping part downwards when the shelf is in position, to cause the rear portion of the shelf to be gripped between the gripping part and the support part, the tightening means being in front of the support, surface-engaging part of the first component.

Shelf holders of this general type are disclosed in U.S. Pat. No. 4,709,892, DE 3 704 889A, WO91/11939, FR 2 701 520, EP 0 330 559A, FR 2 624 708A, FR 2 664 141A, GB 618 669, GB 2 232 343A and U.S. Pat. No. 883,323.

It is desirable to provide a firm fixture for the shelf whilst enabling the tightening to be effected in a simple manner. This requires that proper guidance be provided for the relative movement of the second component during tightening and proper retention of the second component when tightening has been effected, and it is also desirable that the two components can be retained one by the other before mounting in position though it is also desirable for manufacturing convenience that it be possible to assemble the two components together in a simple manner.

The second aspect of the invention relates to a shelf holder for supporting the underside of a shelf and gripping the rear portion of the shelf, the holder comprising a first component having a support part for supporting the bottom of the shelf, a second component moveable vertically with respect to the first component and having a gripping part for bearing on the top of the rear portion of the shelf, and tightening means below the position of the shelf, for causing a relative approach between the gripping part and the support part when the shelf is in position, to cause the rear portion of the shelf to be gripped between the gripping part and the support part, the tightening means being accessible for actuation when the shelf is in position.

One problem with such shelf holders in general is that the tightening means must be readily accessible and easily actuated, but should not be easily visible as they are usually considered rather ugly.

THE INVENTION—FIRST ASPECT

According to the first aspect of the invention, the second component has a connecting part which extends downwards relative to the gripping part so as to pass between the rear of the shelf and a generally vertical surface, and a projecting part which extends forwards from the connecting part below the first component support part but preferably above the lowermost portion of the first component, the projecting part co-acting with the tightening means, and the first component being arranged such that when it is fixed to the generally vertical surface, the second component is not firmly clamped to the generally vertical surface but can move vertically, and if necessary the first, surface-engaging part of the first component defining an opening through which the projecting part of the second component projects.

The first aspect of the invention provides good mechanical stability and good guidance for the movement of the second component, and the two components can be fabricated in a simple manner, particularly by bending sheet metal though other forms of fabrication are possible.

THE INVENTION—SECOND ASPECT

According to the second aspect of the invention, there is a bottom cover piece for covering all of the portion of the shelf support which is below the shelf, to thereby conceal the tightening means, securing means for securing the cover piece in position, and a top cover piece for covering all the portion of the shelf support which is above the shelf and comprising a part for insertion between the second component gripping surface and the shelf top surface before tightening to cause the shelf to be gripped, secured to or integral with a second part which covers all the respective portion of the shelf support.

The second aspect of the invention can provide an attractive shelf support which is easily assembled, fixed to the generally vertical surface and tightened. The bottom cover piece conceals the tightening means. The top cover piece gives a good finish to the arrangement. Though the top cover piece could be as wide as the bottom cover piece, it is preferably not so wide, for instance being between about 50% and about 80% of the width of the bottom cover piece. The cover pieces can for instance be moulded in plastics material.

GENERAL

The generally vertical surface will usually be a wall, but it could be another surface such as that of a post.

The arrangement of the first and second components is preferably such that free relative vertical movement is permissible between them once the shelf holder has been fixed to the generally vertical surface; however slight clamping of the movement is permissible on fixing to the generally vertical surface, provided the tightening motion is possible after the shelf is in position.

The tightening means can be of any suitable type, but is preferably in the form of a screw which passes through a threaded opening in, or captive nut secured to, part of the second component with its end bearing on part of the first component, for instance beneath the first component support part. In a general sense, if suitable cover pieces are used, it would be possible to reverse the arrangement and have the tightening means above the shelf, for example with the second component having a connecting part extending up above the first component gripping part.

The first, surface-engaging part is preferably not just a small zone of the first component but is effectively sufficiently wide and sufficiently high to give good stability to the shelf holder against tipping forwards and rocking sideways. In general, this means that it should bear against the generally vertical surface adjacent the top of the first component and adjacent the bottom of the first component and also adjacent each side of the first component.

Depending on the width of the shelf holder, there can be one tightening means or two spaced tightening means, or even more.

The fixing means will normally be in the form of a hole for screwing to the generally vertical surface, and there can be two or more spaced fixing means, depending on the width of the shelf holder. As an alternative, the fixing means could be on the second component, for example with the first, surface-engaging part providing stability by bearing against the substantially vertical surface, or alternatively or in addition the second component being provided with such a part.

The shelf holder is preferably substantially wider than its front-rear dimension, for instance being at least about three times as wide or about four times as wide. The width may be for instance 150 mm to 200 mm.

The shelf holder is described herein in the orientation it will assume when in position on the generally vertical surface, but it naturally may assume other orientations for instance when being sold. The shelf holder can be sold dissassembled, as a kit of parts, and the invention extends to the shelf holder in this form and also to a pack containing parts for forming the shelf holder.

The two aspects of the invention can be combined.

PREFERRED EMBODIMENTS

The invention will be further described by way of example, with reference to the accompanying drawings, in which:

FIG. 1 is a perspective view of a shelf holder of the invention, without the cover pieces;

FIG. 2 is a vertical section through the shelf holder, fixed to a wall with a shelf in position, along the line II—II in FIG. 5;

FIG. 3 is a perspective view of the first component of the shelf holder;

FIGS. 1 to 13

Figure 4:
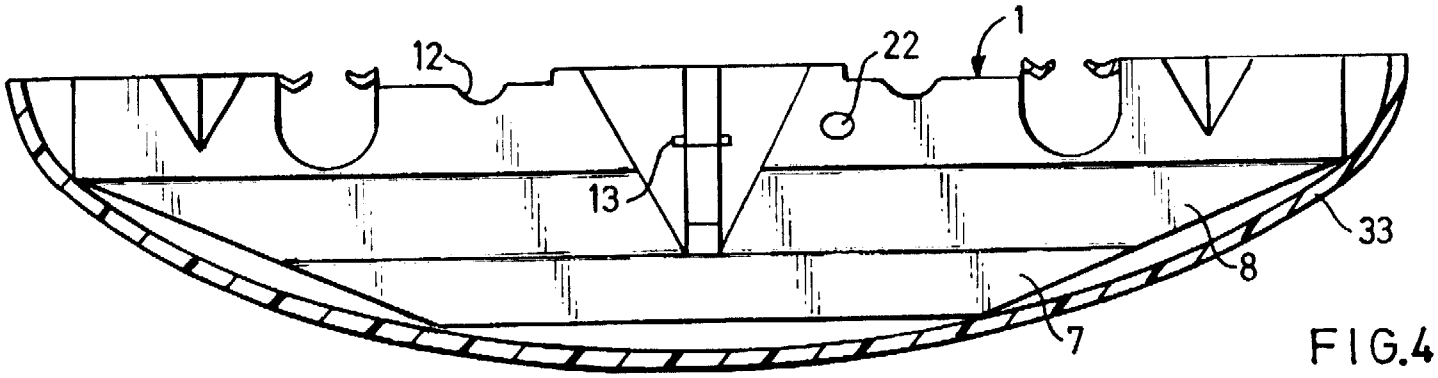
FIG. 4 is a horizontal section through the first component and the bottom cover piece, along the line IV—IV in FIG. 2.

The shelf holder has two main components, namely a first component 1 and a second component 2.

The first component is of inverted L-section and has a wall-engaging part 3 most of which will lie flat against the wall and thus provide a good vertical and horizontal extent for stable mounting, and specifically stability against tipping forwards and rocking sideways. In detail, the wall engaging part 3 provides an upper zone 3*a* (see FIG. 6) and a lower zone 3*b* which are spaced apart vertically, and a left-hand zone 3*c* and a right-hand zone 3*d* which are spaced apart horizontally. The wall-engaging part 3 includes stamped and plunged eyes 4 providing fixing means for screwing to a wall 5 with suitable screws 6 (FIG. 2). The first component 1 also has a support part 7 for engaging the bottom of a shelf S (FIG. 2), the support part 7 being flat apart from an impressed groove 8 for strength. The wall-engaging part 3 and the support part 7 are rigidly braced by impressed inclined ribs 9, 10, the central rib 10 extending almost to the bottom of the wall-engaging part 3 and to the front of the support part 7.

Figure 5:
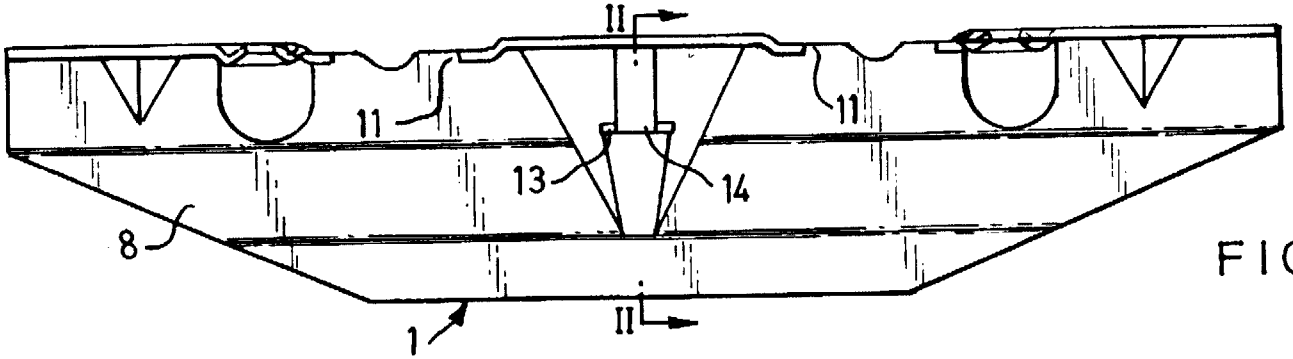
FIG. 5 is a bottom view of the first component.
Figure 6:
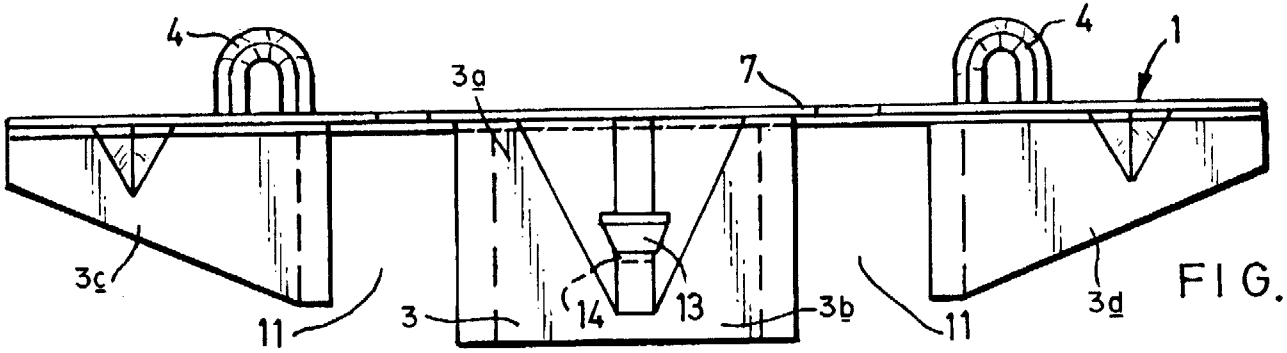
FIG. 6 is a front view of the first component.
Figure 7:
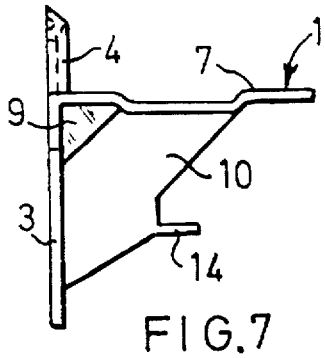
FIG. 7 is a side view of the first component.
Figure 8:
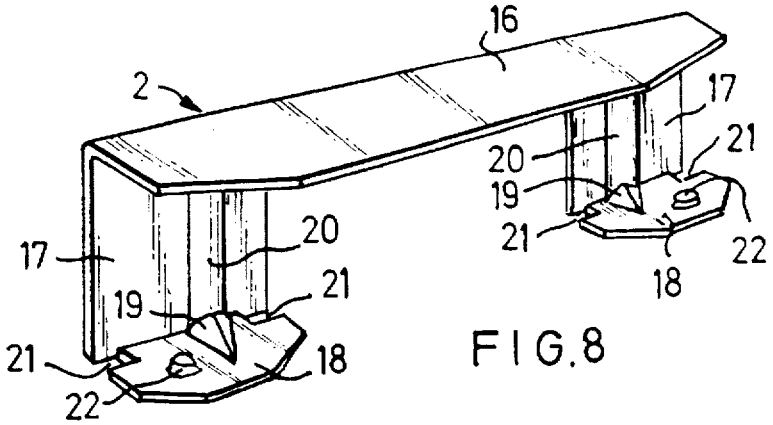
FIG. 8 is a perspective view of the second component.
Figure 9:
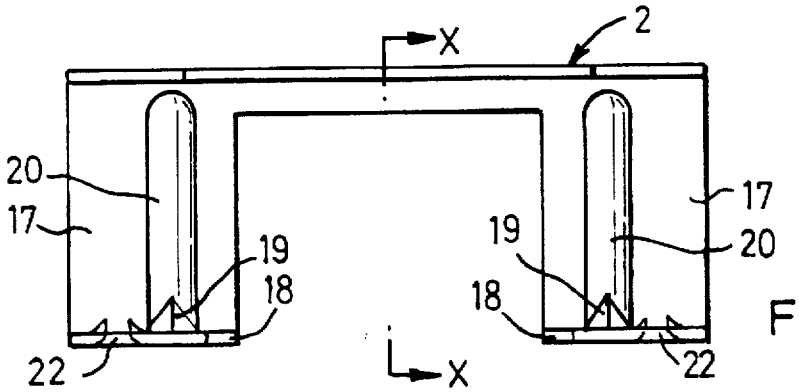
FIG. 9 is a front view of the second component.
Figure 10:
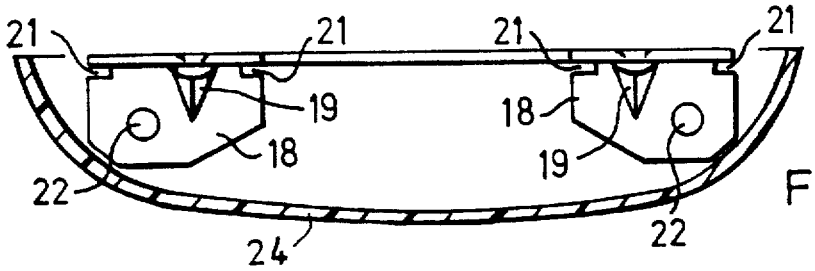
FIG. 10 is a bottom view of the second component and top cover piece.
Figure 11:
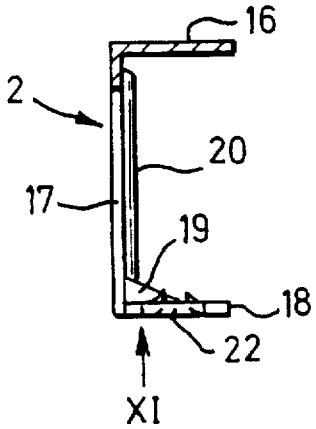
FIG. 11 is a side view of the second component.

The first component 1 defines two spaced openings 11 (FIG. 6) in the form of parallel-sided slots, the edges being rebated (FIG. 5). The support part 7 extends back as far as the wall 5, but has two spaced recesses 12 in its rear portion (FIG. 4). The centre rib 10 has a punched hole 13 (FIGS. 4 and 6) with a protruding tongue 14 (FIGS. 2 and 5). The support part 7 has a punched hole 15.

The second component 2 is of generally U-shape with the limbs facing forwards and is moveable vertically with respect to the first component 1. The second component has a top upper limb, lip or gripping part 16 for engaging the top of the rear portion of the shelf S, has two spaced legs or connecting parts 17, and has two lower limbs, feet or projecting parts 18 which extend forwards from the legs 17, above the level of the bottom of the first component wall-engaging part 3. The feet 18 are braced by impressed inclined ribs 19 and the legs 17 are strengthened by impressed grooves 20. The feet 18 have lateral recesses 21 and also have plunged and tapped holes 22. The holes 22 receive adjusting screws 23 whose heads are lowermost and whose upper ends engage beneath the support part 7, thereby providing tightening means in front of the wall-engaging part 3 for moving the top lip 16 downwards when the shelf S is in position, to cause the rear portion of the shelf S to be gripped between the top lip 16 and the support part 7.

The components 1 and 2 are easily assembled by placing the component 1 within the component 2 with the support part 7 of the component 1 against the underside of the top lip 16 of the component 2 and then moving the component 1 downwards so that the recesses 21 engage over the sides of the openings 11, thereby guiding the relative vertical movement of the second component 2 and, once assembled, preventing the feet 18 of the second component 2 moving backwards or forwards, there being a suitable clearance fit. The legs 17 are received in the recesses 12 in the support part 7 as a clearance fit. The rebated sides of the openings 11 allow the legs 17 to have their side portions behind the sides of the openings 11 without the second component 2 being firmly clamped in position when the first component 1 is fixed by the screws 6.

The first and second components 1, 2 can be cold formed from e.g. 2 mm thick mild steel sheet (e.g. H.R. P&O to British Standard 1449, part 1, 1991) in suitable pressing and bending and other operations.

Figure 13:
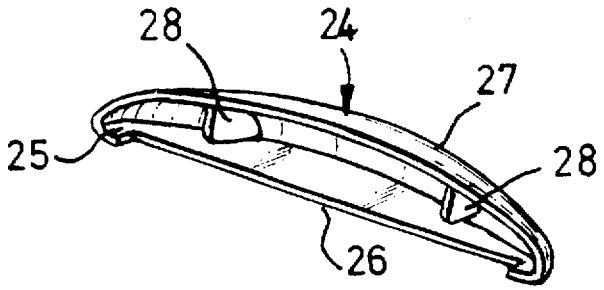
FIG. 13 is a rear perspective view of the top cover piece.
Figure 12:
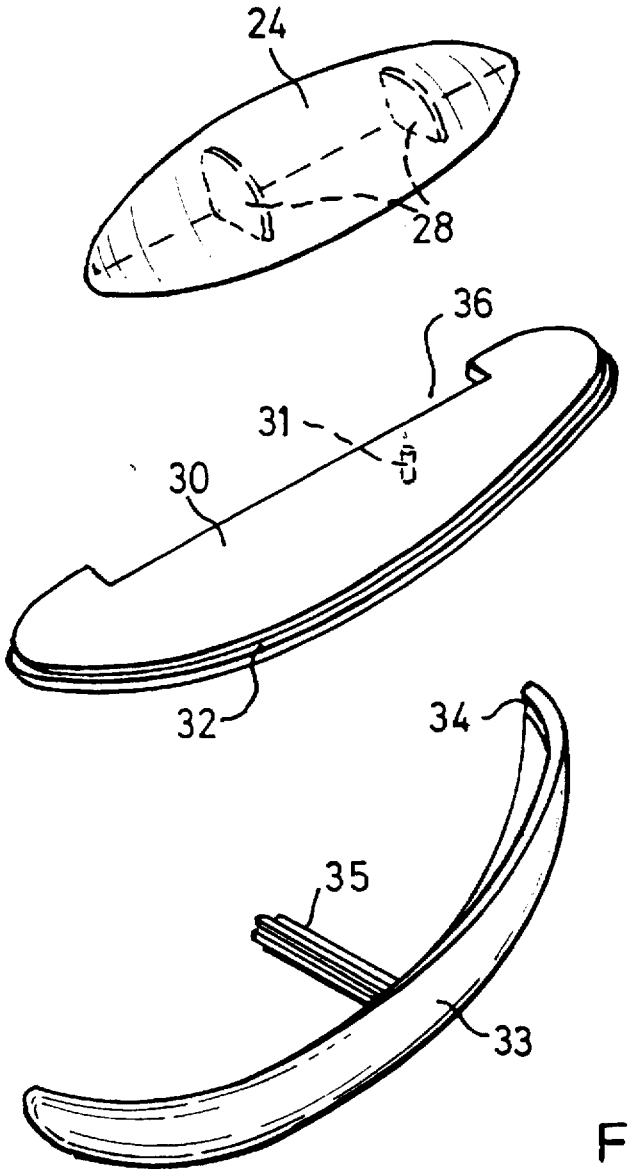
FIG. 12 is an exploded view showing the top and bottom cover pieces.

As shown in FIG. 2, there is an integral top cover piece 24 which conceals the portion of the shelf holder above the shelf S. As shown in FIG. 13, the top cover piece 24 has a planar bottom part 25 with a rear portion provided with a recess 26 to embrace the eyes 4 and the second component 2, and which is inserted between the top lip 16 and the top of the shelf S. The top cover piece has an outer shell 27 and internal locating fins 28 which retain the top cover piece 24 in position on the top lip 16 before the shelf S is put in position.

There is a bottom cover piece 29 in two parts, namely a flat top part 30 which has a peg 31 and a rebated edge 32 forming a male interengaging member, and a shaped shell part 33 with a top lip 34 and a horizontal retainer or peg 35. Prior to placing the shelf S in position, the top part 30, which has a rear recess 36 for embracing the eyes 4, is placed in position on the support part 7 and is located by the peg 31 entering the hole 15. The shelf S is then placed in position and gripped or clamped by tightening the screws 23, the shelf S thereby being supported in a cantilever fashion. The shell part 33 is then placed in position so that the peg 35 enters the hole 13, guided by the tongue 14, and the top lip 34 forms a female interengaging member which engages over the rebated edge 32 of the top part 30. The bottom cover piece 29 now conceals all the portion of the shelf holder below the level of the shelf S.

The cover pieces 24 and 29 can be formed in any suitable material, e.g. plastics material such as high impact polystyrene (e.g. B.P. grade 4230/10000/NJW). It is preferably injection moulded.

Figure 14:
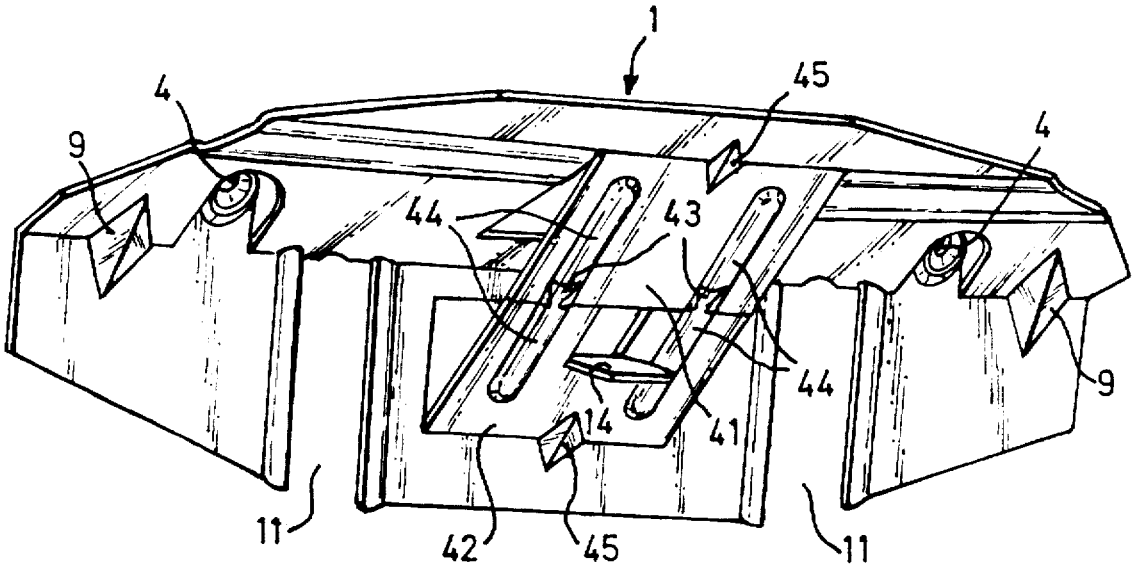
FIG. 14 is a perspective view of the first component of a modified shelf holder.
Figure 15:
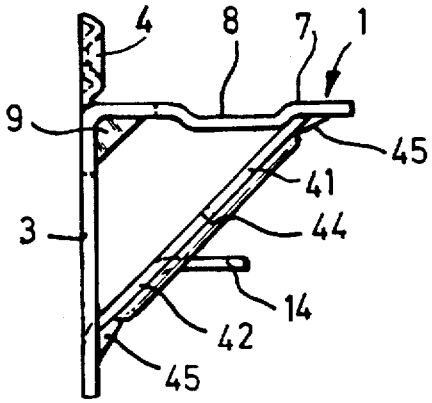
FIG. 15 is a side view of the first component of FIG. 14.

FIGS. 14 and 15

The modified embodiment shown in FIGS. 14 and 15 differs from that in FIGS. 1 to 13 primarily in the bracing in the centre of the first component 1, and the same references are used for items which are the same or similar to those in FIGS. 1 to 13.

Instead of a large central rib 10 providing bracing, there is an inclined brace extending from the underside of the support part 7 and in an inclined direction (roughly at 45° to the horizontal) rearwards and downwards to the wall-engaging part 3, the brace comprising an upper piece 41 cut out from the support part 7 along a rear edge and opposite side edges (which are not necessarily parallel to each other, but are shown as such) and bent down from the support part 7, and a lower piece 42 cut out from the wall-engaging part 3 along a top edge and opposite side edges (which are not necessarily parallel, but are shown as such) and bent forward from the wall-engaging part 3. The lower edge of the upper piece 41 and the upper edge of the lower piece 42 are butted and are interengaged mechanically by the provision of dovetails 43 on one edge and the corresponding cut-outs in the other edge, the dovetails 43 being shown on the lower piece 42, though the arrangement could be reversed.

Strengthening protrusions 44 are impressed in the pieces 41, 42, and, as shown, the dovetails 43 can conveniently be provided in the protrusions 44, of curved form to match the protrusions 44. Small strengthening ribs 45 are impressed where the pieces 41, 42 are bent out from the respective support part 7 or wall-engaging part 3.

FIGS. 14 and 15 show a possible modification of the stamped and plunged eyes 4. In FIGS. 14 and 15, the eyes 4 are shown of circular form rather than of U-form. Either form can be used.

The present invention has been described above purely by way of example, and modifications can be made within the spirit of the invention.

We claim:

1. A shelf holder for fixing to a generally vertical surface, for supporting the underside of a shelf and gripping the rear portion of the shelf, the holder comprising:

a first component having a first, surface-engaging part for engaging the generally vertical surface, a support part for supporting the bottom of the shelf, a lower-most portion, and means for fixing the first component to the generally vertical surface, the first, surface-engaging part defining an opening and defining a portion adjacent the opening;

a second component moveable vertically with respect to the first component whereby when the first component is fixed to the generally vertical surface, the second component is not firmly clamped to the generally vertical surface but can move vertically, the second component having a gripping part for bearing on the top of the rear portion of the shelf; and a tightening screw for moving the gripping part downwards when the shelf is in position, to cause the rear portion of the shelf to be gripped between the gripping part and the support part, the tightening screw being below the first component support part and in front of the first, surface-engaging part of the first component;

the second component having a connecting part which extends downwards relative to the gripping part so as to pass between the rear of the shelf and the generally vertical surface, and a projecting part which extends forwards from the connecting part below the first component support part but above the lowermost portion of the first component and extends forwards through said opening in the first, surface-engaging part of the first component, the second component having a portion adjacent said projecting part which engages behind said first component portion and prevents forward movement of the projecting part relative to the first, surface-engaging part, the projecting part co-acting with the tightening screw;

whereby when the first component is fixed to the generally vertical surface, the second component is not firmly clamped to the generally vertical surface but can move vertically.

2. The shelf holder of claim 1, wherein, as seen looking normal to said generally vertically surface, the first component opening has a vertical side which provides guidance to the relative vertical movement of the second component projecting part relative to the first component.

3. The shelf holder of claim 1, wherein, as seen looking normal to said generally vertical surface, the first component opening has opposed parallel sides, which provide guidance to the vertical movement of the second component projecting part relative to the first component.

4. The shelf holder of claim 2, wherein guidance is provided to the relative vertical movement of the second component projecting part by engagement of the second component projecting part with the side(s) side of the first component opening.

5. The shelf holder of claim 1, wherein a side of the first component opening is defined by a vertical opening side portion whereby the first component opening has a vertical side, said side portion having a rear and defining a rebate to the rear of the vertical side, and the second component connecting part has a side portion lying in the rebate behind the side portion of the opening, thereby providing guidance to the relative vertical movement of the second component projecting part relative to the first component.

6. The shelf holder of claim 1, wherein the first component fixing means are above the level of the first component support part.

7. The shelf holder of claim 1, wherein the first component support part is for engaging the bottom of only the rear portion of the shelf, so that the shelf is supported in a cantilever fashion.

8. The shelf holder of claim 1, wherein the first component is of a generally inverted and the second component is of generally U-shape looking horizontally and parallel to the generally vertical surface, having an upper limb and a lower limb with the limbs projecting forwards.

9. The shelf holder of claim 8, wherein the first component support part is braced on the first component first, surface-engaging part by a depression in the support part which extends down to the surface-engaging part thereby forming an inclined rib.

10. The shelf holder of claim 1, wherein the first component first, surface-engaging part engages the generally vertical surface at least two zones which are spaced apart vertically and at least two zones that are spaced apart horizontally, thereby providing stability against tipping downwards and rocking sideways.

11. The shelf holder of claim 1, and cold formed from sheet metal.

12. The shelf holder of claim 1 wherein said first, shelf-engaging part portion is adjacent and to the side of said opening.

13. The shelf holder of claim 1 wherein the projecting part has an element which projects sideways in front of the first component surface-engaging part and prevents substantial rearward movement of the second component relative to the first component before fixing to the generally vertical surface.

14. A shelf holder for fixing to a generally vertical surface, for supporting the underside of a shelf and gripping the rear portion of the shelf, the holder comprising:

a first component having a first, surface-engaging part for engaging the generally vertical surface, a support part for supporting the bottom of the shelf, and means for fixing the first component to the generally vertical surface, the first, surface-engaging part defining an opening;

a second opening component moveable vertically with respect to the first component whereby when the first component is fixed to the generally vertical surface, the second component is not firmly clamped to the generally vertical surface but can move vertically, the second component having a gripping part for bearing on the top of the rear portion of the shelf; and a tightening screw for moving the gripping part downwards when the shelf is in position, to cause the rear portion of the shelf to be gripped between the gripping part and the support part, the tightening screw being below the first component support part and in front of the first, surface-engaging part of the first component;

the second component having a connecting part which extends downwards relative to the gripping part so as to pass between the rear of the shelf and the generally vertical surface, and a projecting part which extends forwards from the connecting part below the first component support part but above the lowermost portion of the first component and extends forwards through said opening in the first, surface-engaging part of the first component, the projecting part having an element which projects sideways in front of the first component surface-engaging part and prevents substantial rearward movement of the second component relative to the first component before fixing to the generally vertical surface, the projecting part co-acting with the tightening screw.

15. The shelf holder of claim 14, wherein the element and the second component connecting part provide a recess which engages over a side of the opening and prevents substantial forward or rearward movement of the second component relative to the first component before fixing to the generally vertical surface.

16. A shelf holder for fixing to a generally vertical surface, for supporting the underside of a shelf and gripping the rear portion of the shelf, the holder comprising:

a first component having a first, surface-engaging part for engaging the generally vertical surface and defining an opening, a support part defining a substantially horizontal surface which has a rear portion and which defines a recess in its rear portions, and means for fixing the first component to the generally vertical surface;

a second component moveable vertically with respect to the first component whereby when the first component is fixed to the generally vertical surface, the second component is not firmly clamped to the generally vertical surface but can move vertically, the second component having a gripping part for bearing on the top of the rear portion of the shelf; and a tightening screw for moving the gripping part downwards when the shelf is in position, to cause the rear portion of the shelf to be gripped between the gripping part and the support part, the tightening screw being below the first component support part and in front of the first, surface-engaging part of the first component;

the second component having a connecting part which extends downwards relative to the gripping part so as to pass between the rear of the shelf and the generally vertical surface, the connecting part having parallel vertical sides and being received in said recess in the rear portion of the first component support part, passing down through the recess, thereby providing guidance for vertical movement of the second component relative the first component, and a projecting part which extends forwards from the connecting part below the first component support part but above the lowermost portion of the first component and extends forwards through said opening in the first, support-engaging part of the first component, the projecting part co-acting with the tightening screw.

17. A shelf holder for fixing to a generally vertical surface, for supporting the underside of a shelf and gripping the rear portion of the shelf, the holder comprising a first component having a first, surface-engaging part for engaging the generally vertical surface and defining two horizontally-spaced openings, a support part for supporting the bottom of the shelf, and means for fixing the first component to the generally vertical surface;

a second component moveable vertically with respect to the first component whereby when the first component is fixed to the generally vertical surface, the second component is not firmly clamped to the generally vertical surface but can move vertically, the second component having a gripping part for bearing on the top of the rear portion of the shelf; and tightening screws for moving the gripping part downwards when the shelf is in position, to cause the rear portion of the shelf to be gripped between the gripping part and the support part, the tightening screws being below the first component support part and in front of the first, surface-engaging part of the first component;

the second component having two horizontally-spaced connecting parts which extend downwards relative to the gripping part so as to pass between the rear of the shelf and the generally vertical surface, and respective protecting parts which extend forwards from the connecting parts below the first component support part but above the lowermost portion of the first component and extend forwards through respective said openings in the first, surface-engaging part of the first component, the projecting parts co-acting with the tightening screws.

18. A shelf holder for fixing to a generally vertical surface, for supporting the underside of a shelf and gripping the rear portion of the shelf, the holder comprising:

a first component having a first, surface-engaging part for engaging the generally vertical surface, a support part for supporting the bottom of the shelf, and means for fixing the first component to the generally vertical surface, the first, surface-engaging part defining an opening;

a second component moveable vertically with respect to the first component whereby when the first component is fixed to the generally vertical surface, the second component is not firmly clamped to the generally vertical surface but can move vertically, the second component having a gripping part for bearing on the top of the rear portion of the shelf;

a tightening screw for moving the gripping part downwards when the shelf is in position, to cause the rear portion of the shelf to be gripped between the gripping part and the support part, the tightening screw being below the first component support part and in front of the first, surface-engaging part of the first component;

a cover piece for covering all of the portion of the shelf support which is below the shelf;

a further piece which is placed between the bottom of the shelf and the top of the first component support surface before tightening to cause the shelf to be gripped;

a retainer for securing the cover piece in position after the tightening screw has been actuated to cause the shelf to be gripped; and interengaging members on said cover piece and on said further cover piece for interengagement when said cover piece is placed in position after the shelf has been gripped.

19. A shelf holder for supporting the underside of a shelf and gripping the rear portion of the shelf, the holder comprising:

a first component having a support part for supporting the bottom of the shelf;

a second component moveable vertically with respect to the first component and having a gripping part for bearing on the top of the rear portion of the shelf;

a tightening screw below the first component support part, for causing a relative approach between the gripping part and the support part when the shelf is in position, to cause the rear portion of the shelf to be gripped between the gripping part and the support part, the tightening screw being accessible for actuation when the shelf is in position;

a bottom cover piece for covering all of the portion of the shelf support which is below the shelf, to thereby conceal the tightening screw;

a retainer for securing the bottom cover piece in position; and a top cover piece for covering all the portion of the shelf support which is above the shelf and comprising a part for insertion between the second component gripping surface and the shelf top surface before tightening to cause the shelf to be gripped, and a second part which covers all the respective portion of the shelf support and is secured to said insertion point.

20. The shelf holder of claim 19, and comprising a further piece which is placed between the bottom of the shelf and the first component support surface before tightening to cause the shelf to be gripped, the bottom cover piece engaging the further piece when the bottom cover piece is placed in position.

21. A shelf holder for fixing to a generally vertical surface, for supporting the underside of a shelf and gripping the rear portion of the shelf, the holder comprising:

a first component having a first surface-engaging part for engaging the generally vertical surface, a support part for supporting the bottom of the shelf, and means for fixing the first component to the generally vertical surface;

a second component moveable vertically with respect to the first component and having a gripping part for bearing on the top of the rear portion of the shelf, and a tightening screw below the first component support part, for moving the gripping part downwards when the shelf is in position, to cause the rear portion of the shelf to be gripped between the gripping part and the support part, the tightening screw being in front of the first, surface-engaging part of the first component;

the second component having a connecting part which extends downwards relative to the gripping part so as to pass between the rear of the shelf and the generally vertical surface, and a projecting part which extends forwards from the connecting part below the first component support part, the projecting part co-acting with the tightening screw;

whereby when the first component is fixed to the generally vertical surface, the second component is not firmly clamped to the generally vertical surface but can move vertically;

a bottom cover piece for covering all of the portion of the shelf support below the shelf, to thereby conceal the tightening screw;

securing means for securing the cover piece in position; and a top cover piece for covering all the portion of the shelf support which is above the shelf and comprising a part for insertion between the second component gripping surface and the shelf top surface before tightening to cause the shelf to be gripped, and a second part which covers all the respective portion of the shelf support and is secured to said insertion part.

22. The shelf holder of claim 21, and comprising a further piece which is placed between the bottom of the shelf and the first component support part before tightening to cause the shelf to be gripped, the bottom cover piece engaging the further piece when the bottom cover piece is placed in position.

23. A shelf holder for fixing to a generally vertical surface, for supporting the underside of a shelf and gripping the rear portion of the shelf, the holder comprising:

a first component having a generally vertical first part for engaging the generally vertical surface, a generally horizontal support part for supporting the bottom of the shelf, the support part defining an upper side and an underside, the first part projecting below the support part, and an inclined brace extending from the underside of the support part and in an inclined direction rearwards and downwards to the first part, the brace comprising an upper piece having a rear edge and opposite side edges and cut out from the support part along the rear edge and opposite side edges and bent down from the support part and a lower piece having a top edge and opposite side edges and cut out from the first part along the top edge and opposite side edges and bent forwards from the first part, the upper piece defining a lower edge and the lower piece defining an upper edge, the lower edge and the upper edge being connected together;

a second component moveable vertically with respect to the first component and having a gripping part for bearing on the top of the rear portion of the shelf;

means for fixing the shelf holder to the generally vertical surface; and a tightening screw for moving the gripping part downwards, to cause the rear portion of the shelf to be gripped between the gripping part and the support part.

24. The shelf holder of claim 23, wherein said lower and upper edges are interengaged mechanically.

25. The shelf support of claim 23, wherein said lower and upper edges are interengaged by the provision of a dovetail on one said edge and a corresponding cut-out in the other said edge.

* * * * *